US011556077B2

(12) United States Patent
Sakamaki et al.

(10) Patent No.: US 11,556,077 B2
(45) Date of Patent: Jan. 17, 2023

(54) IMAGE FORMATION APPARATUS

(71) Applicant: CANON KABUSHIKI KAISHA, Tokyo (JP)

(72) Inventors: Tomoyuki Sakamaki, Tokyo (JP); Hideki Fujita, Ibaraki (JP); Osamu Ariizumi, Chiba (JP); Masashi Wakisaka, Saitama (JP); Chihiro Tanaka, Chiba (JP); Masashi Abe, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/589,640

(22) Filed: Jan. 31, 2022

(65) Prior Publication Data

US 2022/0260947 A1 Aug. 18, 2022

(30) Foreign Application Priority Data

Feb. 12, 2021 (JP) ..... JP2021-020827

(51) Int. Cl.
*G03G 15/08* (2006.01)

(52) U.S. Cl.
CPC ..... *G03G 15/0808* (2013.01); *G03G 15/0896* (2013.01)

(58) Field of Classification Search
CPC ..... G03G 15/0896; G03G 15/0808
See application file for complete search history.

(56) References Cited

U.S. PATENT DOCUMENTS 5,832,350 A * 11/1998 Kumasaka ..... G03G 15/0808 399/272
2005/0158061 A1* 7/2005 Do ..... G03G 15/0806 399/284
2007/0071505 A1* 3/2007 Do ..... G03G 15/0907 399/272

(Continued)

FOREIGN PATENT DOCUMENTS

JP 2007086447 A * 4/2007
JP 2007086447 A 4/2007

(Continued)

*Primary Examiner* — Sevan A Aydin
(74) *Attorney, Agent, or Firm* — Canon U.S.A., Inc. I.P. Division

(57) ABSTRACT

An image formation apparatus includes an image-bearing member, an exposure device, an electro-conductive member, a bias application unit and a development device having a development roller and a toner supply roller. The bias application unit configured to apply biases to the toner supply roller, the development roller, and the electro-conductive member during image formation so that a first potential difference between the toner supply roller and the development roller and a second potential difference between the electro-conductive member and the development roller cause normally charged toner to travel respectively from the toner supply roller and the electro-conductive member to the development roller, and a third potential difference between the electro-conductive member and the toner supply roller causes normally charged toner to travel from the electro-conductive member to the toner supply roller. The second potential difference is larger than the first potential difference and is larger than the third potential difference.

16 Claims, 6 Drawing Sheets

(56) References Cited

U.S. PATENT DOCUMENTS

| | | | | |
|---|---|---|---|---|
| 2012/0063815 | A1* | 3/2012 | Seki | G03G 15/065<br>399/265 |
| 2014/0241760 | A1* | 8/2014 | Shimomura | G03G 15/0808<br>399/284 |

FOREIGN PATENT DOCUMENTS

| | | | | |
|---|---|---|---|---|
| JP | 2009025393 | A | * | 2/2009 |
| JP | 2009025393 | A | | 2/2009 |
| JP | 2011141354 | A | | 7/2011 |
| JP | 2017015942 | A | * | 1/2017 |
| JP | 2017021278 | A | | 1/2017 |

* cited by examiner

IMAGE FORMATION APPARATUS

BACKGROUND

Field

The present disclosure relates to an image formation apparatus that includes a development device including a toner supply roller configured to supply only toner to a development roller.

Description of the Related Art

The development device discussed in Japanese Patent Application Laid-Open No. 2017-21278 has a developer container that stores a developer including toner and a carrier, a development roller that carries and conveys the toner to a development position, and a toner supply roller that carries and conveys the developer supplied from a developer circulation path and supplies only the toner to the development roller. The development device is provided with a toner blocking member for blocking toner separated from the development roller without having been used for development and floating in a space between the toner supply roller and the development roller and the wall part of the developer container. The blocking member is arranged in the vicinity of the development roller in a space between a magnet roller and the development roller and the wall part of the developer container, which is located downstream of the position where the development roller is closest to the toner supply roller as seen in the rotation direction of the toner supply roller.

In the configuration discussed in Japanese Patent Application Laid-Open No. 2017-21278, there is formed a potential difference between the toner supply roller and the development roller during an image formation operation, which can cause normally-charged toner to migrate from the toner supply roller to the development roller, and the same potential is applied to the toner blocking member and the toner supply roller.

In the configuration discussed in Japanese Patent Application Laid-Open No. 2017-21278, the toner separated from the development roller without having been used for development and floating in a gap between the toner blocking member and the development roller can be collected by an electric field during an image formation operation. However, according to the configuration discussed in Japanese Patent Application Laid-Open No. 2017-21278, the same potential is applied to the toner blocking member and the toner supply roller during an image formation operation, so that the toner floating in the gap between the toner blocking member and the toner supply roller cannot be by an electrical field. As a result, during an image formation operation, a part of the toner separated from the development roller without having been used for development and floating in the space among the toner supply roller and the development roller and the wall part of the developer container may be scattered to the outside of the development device by a stream of air.

SUMMARY

The present disclosure is directed to providing an image formation apparatus that includes a development device including a toner supply roller configured to supply only toner to a development roller and is capable of returning toner scattered at a portion where the development roller faces the toner supply roller to a circulation path during an image formation operation.

According to an aspect of the present disclosure, an image formation apparatus includes an image-bearing member, an exposure device configured to expose the image-bearing member to form an electrostatic latent image on the image-bearing member, a development device including first and second chambers, first and second conveyance screws, a rotatable development roller, and a rotatable toner supply roller, wherein the first chamber is configured to accommodate a developer containing toner and a carrier, wherein the second chamber is divided from the first chamber by a partition wall and configured to form a circulation path of the developer between the second chamber and the first chamber, wherein the first conveyance screw is arranged in the first chamber and configured to convey the developer in a first direction, wherein the second conveyance screw is arranged in the second chamber and configured to convey the developer in a second direction opposite to the first direction, wherein the development roller is arranged facing the image-bearing member and configured to carry and convey the toner to a development position where the electrostatic latent image formed on the image-bearing member is developed, and wherein the toner supply roller is arranged facing the development roller and configured to carry and convey the developer supplied from the first chamber and supply only the toner to the development roller, where a rotation direction of the toner supply roller is opposite to a rotation direction of the development roller at a position where the toner supply roller and the development roller face each other, an electro-conductive member arranged facing the toner supply roller and the development roller, downstream of the development position and upstream of a position where the toner supply roller is positioned closest to the development roller in the rotation direction of the development roller, and a bias application unit configured to apply biases to the toner supply roller, the development roller, and the electro-conductive member during an image formation operation so that (i) a first potential difference is formed between the toner supply roller and the development roller to cause normally charged toner to travel from the toner supply roller to the development roller, (ii) a second potential difference is formed between the electro-conductive member and the development roller to cause normally charged toner to travel from the electro-conductive member to the development roller, and (iii) a third potential difference is formed between the electro-conductive member and the toner supply roller to cause normally charged toner to travel from the electro-conductive member to the toner supply roller, wherein the second potential difference is larger than the first potential difference and is larger than the third potential difference.

Further features of the present disclosure will become apparent from the following description of exemplary embodiments with reference to the attached drawings.

DESCRIPTION OF THE EMBODIMENTS

Figure 1:
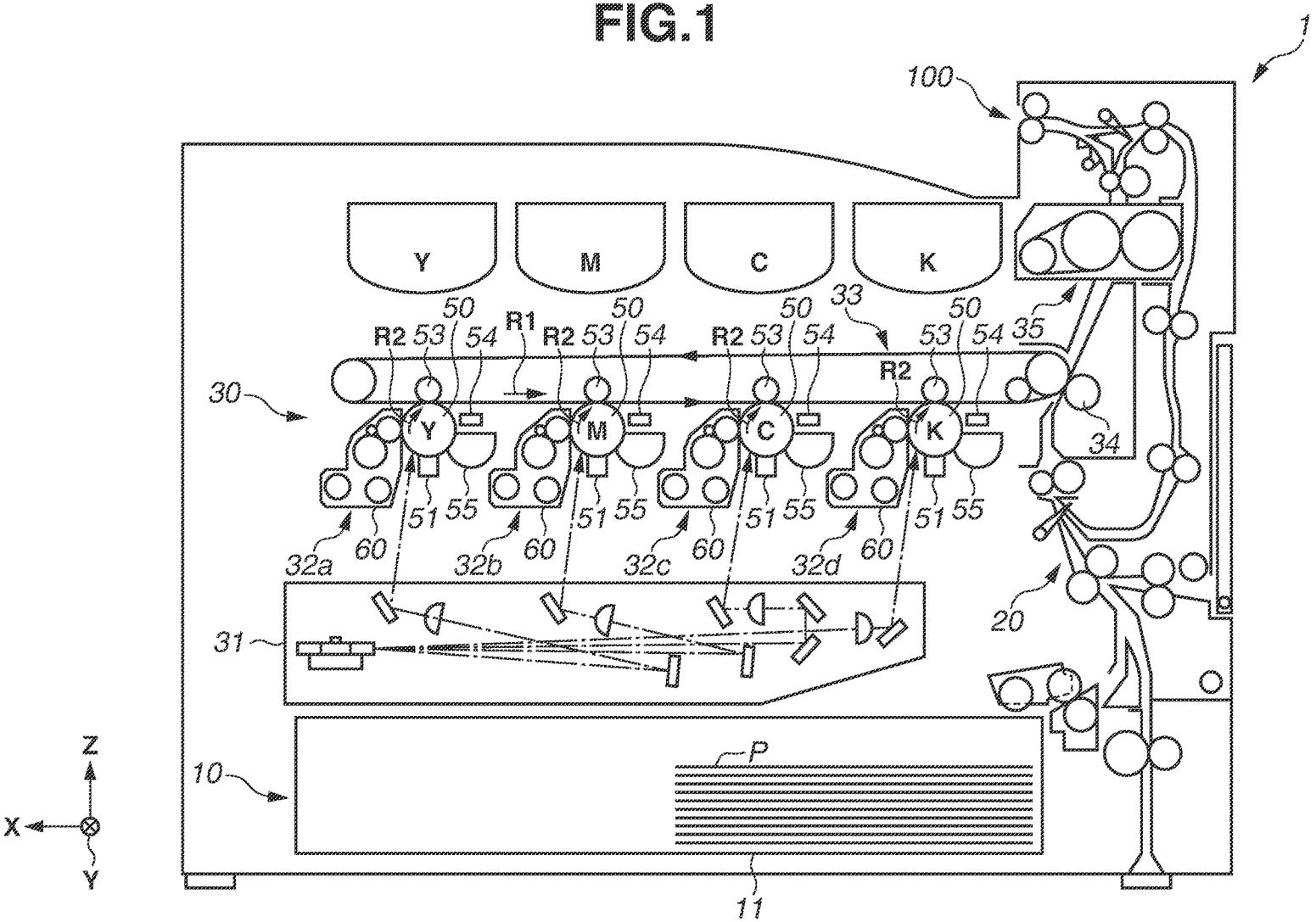
FIG. 1 is a cross-sectional view of a configuration of an image formation apparatus according to a first exemplary embodiment.

Hereinafter, exemplary embodiments of the present disclosure will be described with reference to the drawings. However, the following exemplary embodiments do not limit the present disclosure defined in the claims, and all of combinations of features described in the first exemplary embodiment are not necessarily essential to the solutions of the present disclosure. The present disclosure can be carried out in various use applications, such as printers, various printing machines, photocopiers, facsimiles, and multi-function apparatuses.

Identical or equivalent components illustrated in the drawings are given identical reference numerals and signs and will not be repeatedly described.

X axis, Y axis, and Z axis are orthogonal to one another, Z axis is substantially parallel to the vertical direction, and Y axis and Z axis are substantially parallel to the horizontal direction.

Configuration of Image Formation Apparatus

An image formation apparatus 1 according to the first exemplary embodiment of the present disclosure will be described with reference to FIG. 1. FIG. 1 is a cross-sectional view of the image formation apparatus 1 according to the first exemplary embodiment of the present disclosure. The image formation apparatus 1 forms images on sheets P. In the first exemplary embodiment, the image formation apparatus 1 is a printer. The image formation apparatus 1 employs a tandem system and includes a feed unit 10, a conveyance unit 20, an image formation unit 30, and a discharge unit 100.

The feed unit 10 includes a cassette 11 that stores a plurality of sheets P. The sheets P are sheets of paper or synthetic resin. The feed unit 10 feeds the sheets P from the cassette 11 to the conveyance unit 20. The conveyance unit 20 conveys the sheets P to the image formation unit 30. The image formation unit 30 forms images on the sheets P. The conveyance unit 20 conveys the sheets P with the images formed thereon to the discharge unit 100. The discharge unit 100 discharges the sheets P to the outside of the image formation apparatus 1.

The image formation unit 30 includes an exposure unit 31, a unit 32*a*, a unit 32*b*, a unit 32*c*, a unit 32*d*, an intermediate transfer belt 33, a secondary transfer roller 34, and a fixing unit 35.

The exposure unit 31 irradiates each of the units 32*a* to 32*d* with light based on image data to form an electrostatic latent image on each of the units 32*a* to 32*d*.

The unit 32*a* forms a yellow toner image based on the electrostatic latent image. The unit 32*b* forms a magenta toner image based on the electrostatic latent image. The unit 32*c* forms a cyan toner image based on the electrostatic latent image. The unit 32*d* forms a black toner image based on the electrostatic latent image.

The intermediate transfer belt 33 rotates in a rotation direction R1. The four color toner images are transferred from the units 32*a* to 32*d* to the outer surface of the intermediate transfer belt 33 such that the four color toner images are superimposed on each other to form an image. The secondary transfer roller 34 transfers the image formed on the outer surface of the intermediate transfer belt 33 to the sheets P. The fixing unit 35 heats and presses the sheets P to fix the image to the sheets P.

Each of the units 32*a* to 32*d* includes a photoconductive drum 50 (image-bearing member), a charging device 51, a development device 60, a primary transfer roller 53, a discharger 54, and a cleaner 55.

The plurality of photoconductive drums 50 is arranged in abutment with the outer surface of the intermediate transfer belt 33 along the rotation direction R1 of the intermediate transfer belt 33. The plurality of primary transfer rollers 53 is provided to correspond to the plurality of photoconductive drums 50 and faces the plurality of respective photoconductive drums 50 with the intermediate transfer belt 33 therebetween.

In each of the unis 32*a* to 32*d*, the charging device 51, the development device 60, the primary transfer roller 53, the discharger 54, and the cleaner 55 are arranged in order along the peripheral surface of the corresponding photoconductive drum 50.

The photoconductive drum 50 rotates in a rotation direction R2. The charging device 51 electrically charges the peripheral surface of the photoconductive drum 50. The peripheral surface of the photoconductive drum 50 is irradiated with light from the exposure unit 31 to form an electrostatic latent image.

The development device 60 causes toner to adhere to the electrostatic latent image formed on the peripheral surface of the photoconductive drum 50 to develop the electrostatic latent image, thereby forming a toner image on the peripheral surface of the photoconductive drum 50. That is, the photoconductive drum 50 carries the toner image.

The primary transfer roller 53 transfers the toner image carried by the photoconductive drum 50 onto the outer surface of the intermediate transfer belt 33.

The discharger 54 eliminates static electricity from the peripheral surface of the photoconductive drum 50. The cleaner 55 removes a residual toner image from the peripheral surface of the photoconductive drum 50.

The image formation apparatus 1 is a printer in the present exemplary embodiment but may be a photocopier, a facsimile, or a multi-function machine. The multi-function machine includes, for example, at least two devices of a photocopier, a printer, a facsimile, and a scanner. The image formation apparatus 1 is a color printer but may be a monochrome printer.

Figure 2:
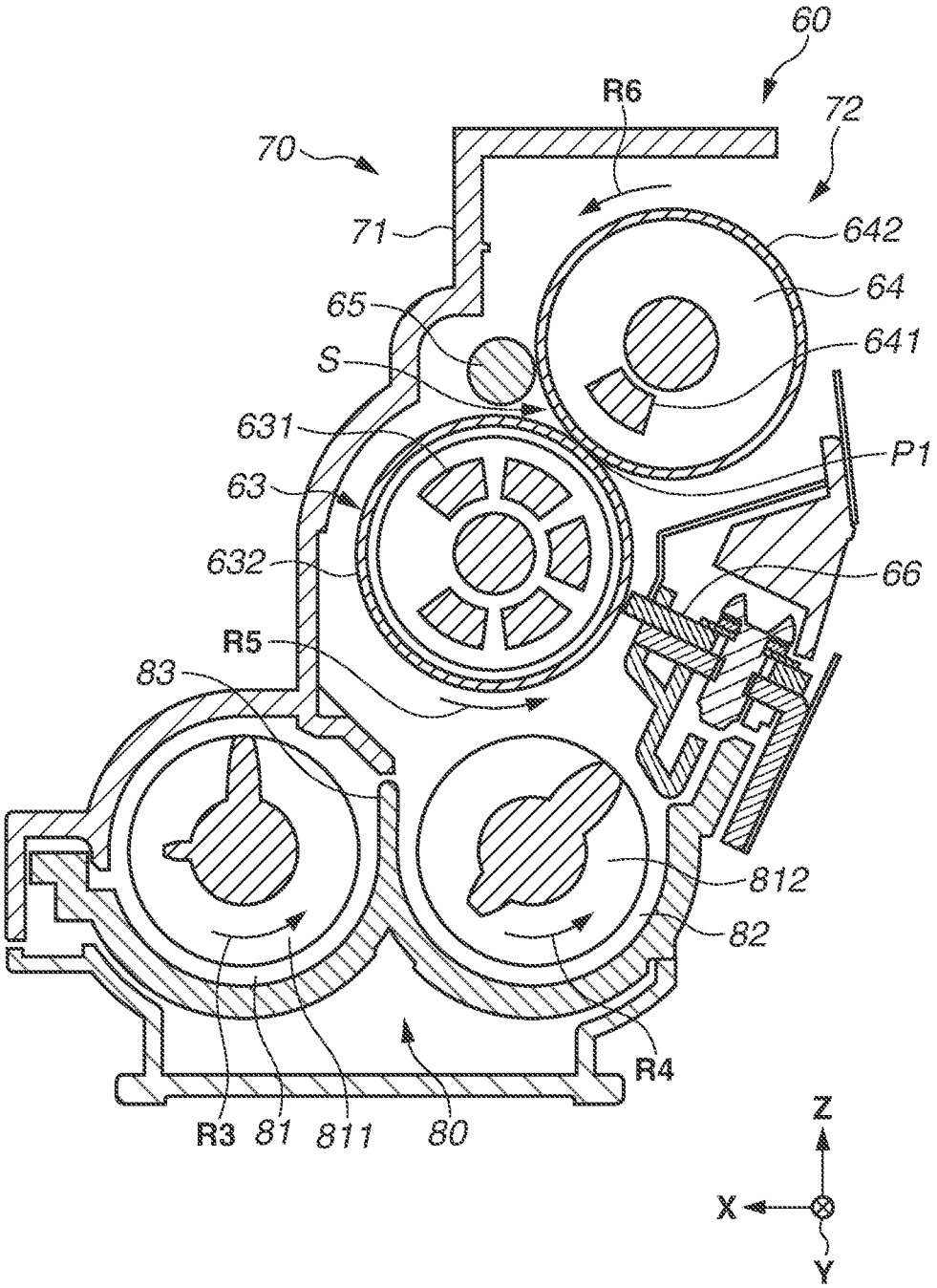
FIG. 2 is a cross-sectional view of a configuration of a development device according to the first exemplary embodiment.
Figure 3:
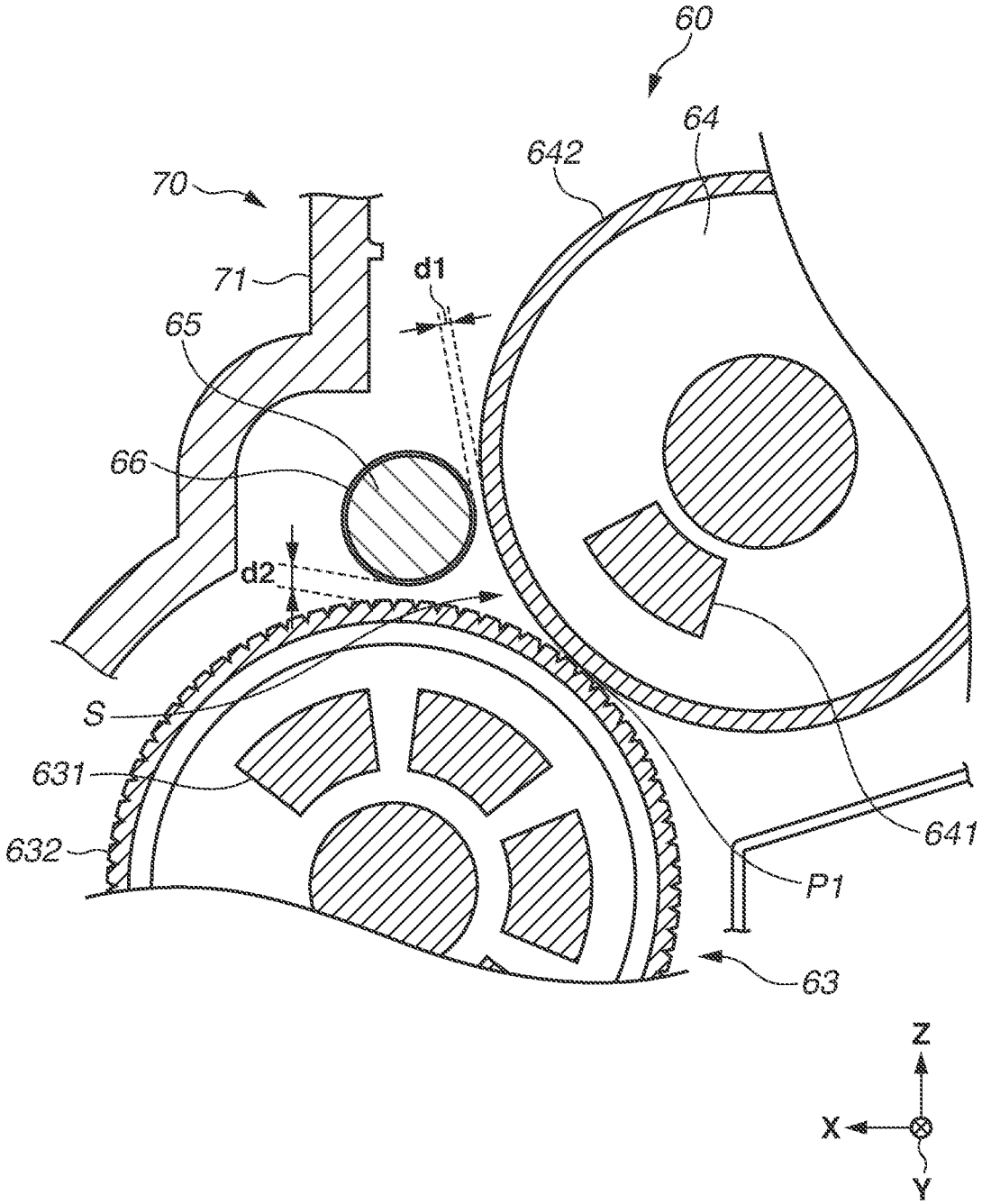
FIG. 3 is an enlarged cross-sectional view of a configuration of the development device according to the first exemplary embodiment.

Next, the development device 60 according to the first exemplary embodiment of the present disclosure will be described with reference to FIGS. 2 and 3. FIG. 2 is a cross-sectional view of the development device 60 according to the first exemplary embodiment of the present disclosure. FIG. 3 is an enlarged view of a toner blocking member 65 and the neighborhood thereof in the cross section of the development device 60 illustrated in FIG. 2.

As illustrated in FIG. 2, the development device 60 includes a housing 70 (developer container), a developer storage unit 80 (developer container), a magnet roller 63 (toner supply roller), a development roller 64 (toner bearer), the toner blocking member 65 (electro-conductive member), and a regulation blade 66.

The developer storage unit 80, the magnet roller 63, the development roller 64, the toner blocking member 65, and the regulation blade 66 are provided inside the housing 70. The housing 70 includes a wall part 71 and an opening 72.

The developer storage unit 80 stores a two-component developer including toner and a carrier (hereinafter, simply called developer). The developer storage unit 80 includes a first conveyance chamber 81, a second conveyance chamber 82, and a partition wall 83. The developer storage unit 80 is partitioned into the first conveyance chamber 81 and the second conveyance chamber 82 by the partition wall 83.

The first conveyance chamber 81 includes a first conveyance screw 811. The second conveyance chamber 82 has a second conveyance screw 812. The first conveyance screw 811 rotates in a rotation direction R3 to convey the developer while stirring the developer in the first conveyance chamber 81. The second conveyance screw 812 rotates in a rotation direction R4 that is the same as the rotation direction R3 to convey the developer while stirring the developer in the second conveyance chamber 82. As a result, the developer is conveyed while being circulated between the first conveyance chamber 81 and the second conveyance chamber 82. That is, there is formed a circulation path for the developer between the first conveyance chamber 81 and the second conveyance chamber 82.

The toner is electrically charged by being stirred by the first conveyance screw 811 and the second conveyance screw 812. In the first exemplary embodiment, the toner is positively charged toner. That is, in the first exemplary embodiment, the normally charged toner is positively charged.

The second conveyance screw 812 supplies the developer to the magnet roller 63.

The magnet roller 63 is arranged inside the housing 70. The magnet roller 63 carries the developer on the surface thereof.

The magnet roller 63 faces the second conveyance chamber 82 and is rotatably supported by the housing 70. The magnet roller 63 includes a magnet 631 and a sleeve 632. The sleeve 632 is rotatable and cylindrical in shape. The magnet 631 is fixedly arranged inside the sleeve 632 so as not to rotate. That is, the sleeve 632 rotates in a rotation direction R5 with the magnet 631 remaining still. The magnet 631 has five magnetic poles N1, S1, S2, N2 and S3. In the first exemplary embodiment, the five magnetic poles N1, S1, S2, N2 and S3 have magnetic flux densities 100 mT, 50 mT, 50 mT, 60 mT, and 60 mT (peak values of magnetic flux density Br in the normal direction of the magnet roller 63), respectively.

The regulation blade 66 is attached to the housing 70 along the longitudinal direction of the magnet roller 63. As seen in the rotation direction R5 of the magnet roller 63, the regulation blade 66 is arranged upstream of a closest position P1 on the development roller 64 with respect to the magnet roller 63 are closest to each other (a position on the development roller 64 where the development roller 64 is closest to the magnet roller 63). There is formed a slight gap between the leading end of the regulation blade 66 and the magnet roller 63.

The regulation blade 66 is arranged so as to face the magnet roller 63 and regulates the thickness of a layer of the developer carried by the magnet roller 63 (the amount of the developer carried by the magnet roller 63).

The development roller 64 is arranged so as to face the magnet roller 63 within the housing 70. The development roller 64 receives the toner carried by the magnet roller 63. The development roller 64 carries and conveys the toner to the position where the electrostatic latent image is to be formed (development position) on the photoconductive drum 50. The development roller 64 is rotatably supported by the housing 70. The development roller 64 includes a magnet 641 and a sleeve 642. The sleeve 642 is rotatable and cylindrical in shape. The magnet 641 is fixedly arranged inside the sleeve 642 so as not to rotate. That is, the sleeve 642 rotates in a rotation direction R6 with the magnet 641 remaining still.

The magnet 641 has one magnetic pole S4. The magnet roller 63 and the development roller 64 faces each other with a predetermined gap therebetween at the facing position (the closest position P1). In the first exemplary embodiment, the predetermined gap is 250 μm. The magnetic pole S4 of the magnet 641 is opposite to the magnetic pole (N1 pole) of the magnet 631 which the magnetic pole S4 faces. In the first exemplary embodiment, the S4 pole has a magnetic flux density of 50 mT (a peak value of magnetic flux density Br in the normal direction of the development roller 64).

The magnet roller 63 supplies only the toner to the development roller 64 by using an electric field formed between the magnet roller 63 and the development roller 64 at the part of the development roller 64 facing the magnet roller 63 (the closest position P1). At the part of the development roller 64 facing the magnet roller 63, a slight amount of carrier in the developer carried by the magnet roller 63 may adhere to the development roller 64. Even in this case, it is considered that the magnet roller 63 supplies only the toner in the developer carried by the magnet roller 63 to the development roller 64.

A direct-current voltage and an alternating-current voltage are applied to the magnet roller 63. A direct-current voltage and an alternating-current voltage are also applied to the development roller 64. The direct-current voltage and the alternating-current voltage are applied to the magnet roller 63 and the development roller 64 from a development bias power source (bias application unit) via a bias control circuit. The normally charged toner is suppled from the magnet roller 63 to the development roller 64 due to a difference in potential between the voltage applied to the magnet roller 63 and the voltage applied to the development roller 64. After the development processing, the toner on the development roller 64 is collected by the magnet roller 63 due to the effect of an alternating-current component in the potential difference between the voltage applied to the magnet roller 63 and the voltage applied to the development roller 64.

Figure 4:
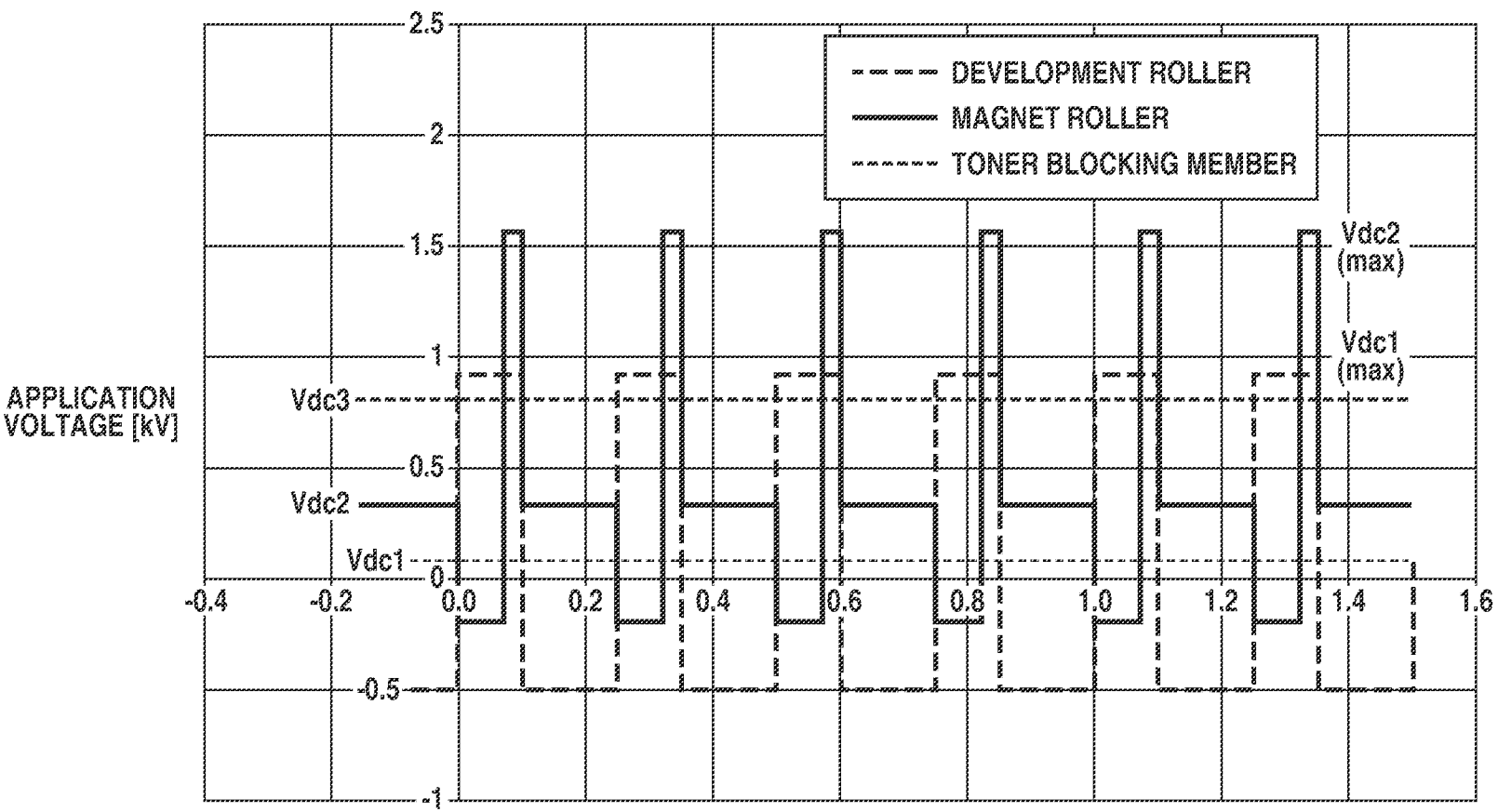
FIG. 4 is a schematic view of waveforms of biases applied to a development roller, a magnet roller, and a toner blocking member according to the first exemplary embodiment.

FIG. 4 is a schematic view of waveforms of biases applied to the development roller 64, the magnet roller 63, and the toner blocking member 65 in the first exemplary embodiment. As illustrated in FIG. 4, a development bias is applied to the development roller 64, and the development bias has an alternating-current component with a frequency of 4 kHz (f1=4 kHz), a peak-to-peak voltage of 1.4 kV (Vpp1=1.4 kV) and a duty ratio of 40% (Dslv=40%), and a direct-current component of 70 V (Vdc1=70 V) which are superimposed on each other.

In the first exemplary embodiment, a development bias with a frequency of 10 kHz (f2=10 kHz), a peak-to-peak voltage of 1.75 kV (Vpp2=1.75 kV), and a duty ratio of 30% (Dmag=30%) is applied to the magnet roller 63. The development bias has an alternating-current component of a blank pulse waveform in which a blank period of 1.5 cycles is provided every time immediately after the end of a positive (+) component and a direct-current component of 340 V (Vdc2=340 V) which are superimposed on each other.

The duty ratios of the bias waveforms will be described with reference to the schematic diagram of FIG. 5. The duty ratio Dslv indicates the duty ratio on the time axis of the side where the toner is dispersed from the development roller 64 to the photoconductive drum 50 (the side with the same polarity as that of the toner). The duty ratio Dmag indicates the duty ratio on the time axis of the side where the toner is caused to fly from the magnet roller 63 to the development roller 64 (the side with the same polarity as that of the toner).

Figure 5:
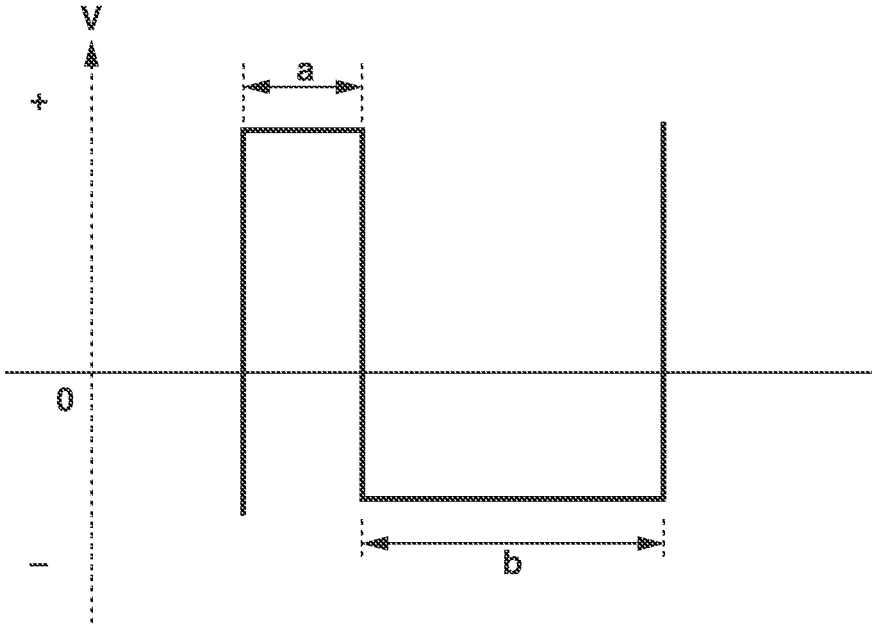
FIG. 5 is a schematic diagram illustrating a duty ratio of a bias waveform.
Figure 6:
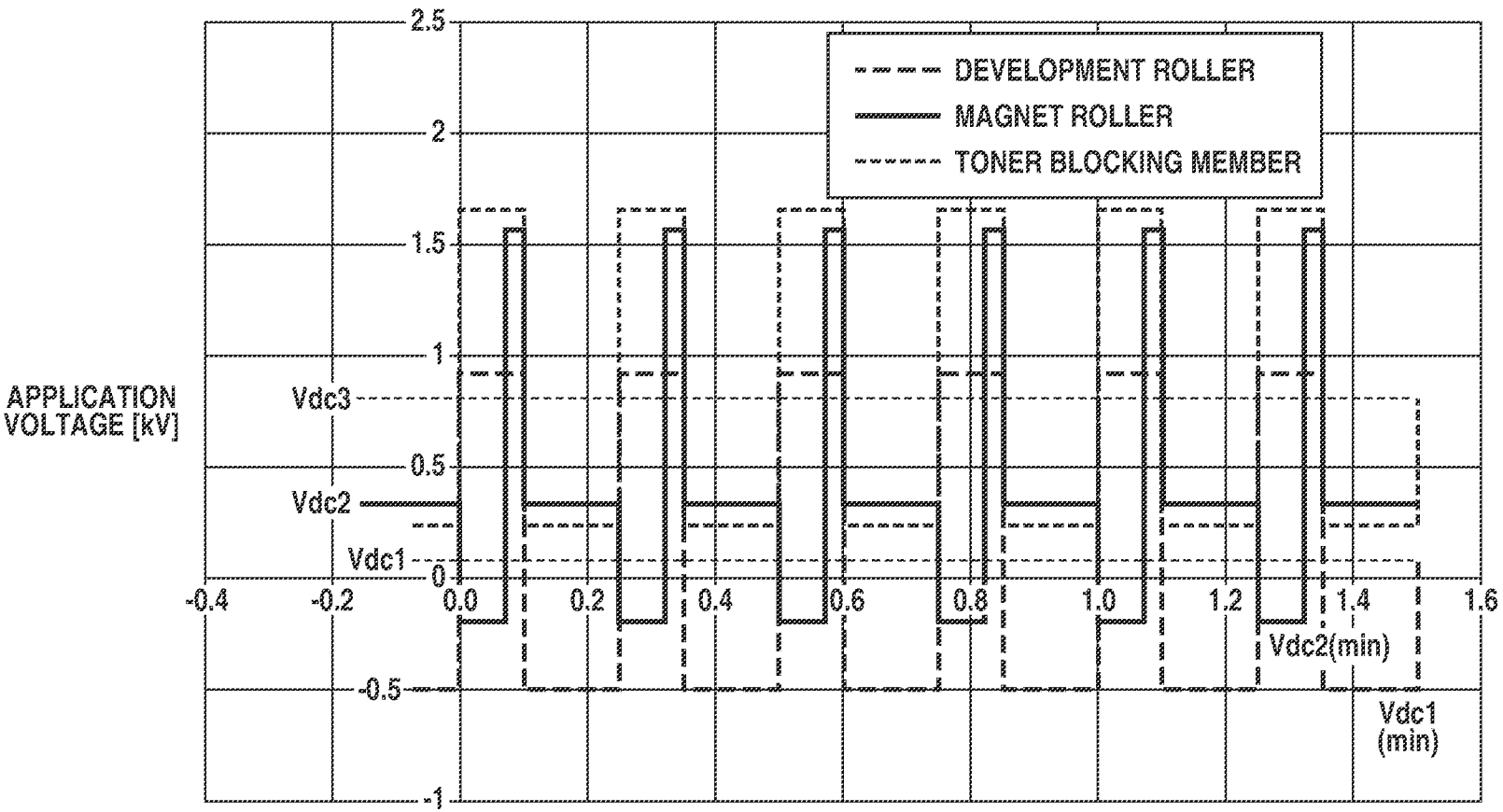
FIG. 6 is a schematic view of waveforms of biases applied to a development roller, a magnet roller, and a toner blocking member according to a second exemplary embodiment.

For example, if normally charged toner is used and the positive potential is on the upper side and it is assumed that the upper direction and the lower direction of FIG. 5 indicate a positive potential and a negative potential, respectively, a duty ratio Dp can be expressed as $Dp=\{a/(a+b)\}\times 100$ where a is a time during which the electric field for causing the toner to fly is applied and b is a time during which an electric field for withdrawing the toner is applied. That is, the duty ratio Dp can be expressed in the percentage of the time during which the positive potential is applied with respect to the overall application time.

If negatively charged toner is used, the duty ratio is expressed as $DP=\{b/(a+b)\}\times 100$.

As described above, since the toner used in the first exemplary embodiment is positively charged toner, the toner is caused to move from the magnet roller 63 to the development roller 64 by setting the value of Vdc1 to be greater than the value of Vdc2. In the first exemplary embodiment, phase alignment is performed such that the timing for application of the positive (+) component of the bias to the development roller 64 matches the timing for application of the negative (−) component of the bias to the magnet roller 63. This periodically inverts the magnitude relationship between the potential of the development roller 64 and the potential of the magnet roller 63 if the alternating-current components are included, which produces the effect of collecting the toner on the development roller 64 by the magnet roller 63 after the development process. On the other hand, such a configuration in which the toner is transferred between the development roller 64 and the magnet roller 63 by the development biases as described above makes the toner likely to float.

Accordingly, during an image formation operation (i.e., during activation of the development device 60), the rotation of the magnet roller 63 and the development roller 64 causes the toner to scatter and float from the magnet roller 63, the development roller 64, and the part of the development roller 64 facing the magnet roller 63. The floating toner floats in a space S between the magnet roller 63 and the development roller 64 and the wall part 71 of the housing 70.

As illustrated in FIG. 4, in the first exemplary embodiment, the application of the alternating-current component of the bias to the magnet roller 63 is basically stopped during the application of the negative (−) component of the bias to the development roller 64. This is to prevent an occurrence of a leak (electrical discharge) which is caused by the potential difference between the development roller 64 and the magnet roller 63 from becoming large.

In general, in the space S between the magnet roller 63 and the development roller 64 and the wall part 71 of the housing 70, a flow of air is generated by the rotation of the magnet roller 63 and the rotation of the development roller 64. Thus, the pressure inside the housing 70 becomes higher than the pressure outside the housing 70. This generates a flow of air causing the air to move from the inside to the outside of the housing 70. As a result, in the space S, the toner having not been used for development is separated from the development roller 64 by a magnetic brush, and the toner separated from the development roller 64 may float and scatter along the flow of air to the outside of the development device 60 through the opening in the housing 70. In particular, if the circumferential speed of the photoconductive drum 50 is equal to or higher than a predetermined circumferential speed (for example, 180 mm/second or higher), the flow speed of the air becomes high. As a result, the toner significantly scatters from the magnet roller 63, the development roller 64, and the part of the development roller 64 facing the magnet roller 63.

As a countermeasure against this phenomenon, in the first exemplary embodiment, the toner blocking member 65 is arranged so as to substantially face both the development roller 64 and the magnet roller 63 downstream of the closest position P1 where the development roller 64 and the magnet roller 63 are closest to each other as seen in the rotation direction of the magnet roller 63. The toner blocking member 65 is arranged downstream of the position where the development roller 64 develops the electrostatic latent image formed on the photoconductive drum 50 as seen in the rotation direction of the development roller 64 and upstream of the closest position P1 where the development roller 64 and the magnet roller 63 are closest to each other as seen in the rotation direction of the development roller 64. The toner blocking member 65 is arranged at a position closer to the development roller 64 than the magnet roller 63. That is, the toner blocking member 65 is arranged in the space S between the magnet roller 63 and the development roller 64 and the wall part 71 such that the shortest distance between the toner blocking member 65 and the development roller 64 is shorter than the shortest distance between the toner blocking member 65 and the magnet roller 63.

The toner blocking member 65 is desirably formed in a cylindrical shape or a columnar shape. As compared with the toner blocking member 65 in a cuboidal shape with edges, the toner blocking member 65 in a cylindrical shape or columnar shape can be accurately manufactured with little warpage in the surface. In the first exemplary embodiment, the toner blocking member 65 is formed in a columnar shape. The toner blocking member 65 is supported by the housing 70. The toner blocking member 65 is a weakly magnetic or non-magnetic metal member. If the toner blocking member 65 is weakly magnetic, the toner blocking member 65 is desirably made of austenitic stainless steel. The toner blocking member 65 is an electro-conductive member made of an electro-conductive material. The diameter of the toner blocking member 65 is 4 mm or more, for example.

As illustrated in FIG. 3, a distance d1 (shortest distance) between the toner blocking member 65 and the development roller 64 is desirably a predetermined dimension or less. In the first exemplary embodiment, the distance d1 between the toner blocking member 65 and the development roller 64 is 0.3 mm or less. A distance d2 (shortest distance) between the toner blocking member 65 and the magnet roller 63 is also desirably a predetermined dimension or less.

In the first exemplary embodiment, the distance d2 between the toner blocking member 65 and the magnet roller 63 is 2 mm or less. The magnet roller 63 carries the developer including the carrier, and thus setting the distance d2 to a distance approximately equivalent to the maximum magnetic brush length at the part of the magnet roller 63 facing the toner blocking member 65 enhances the effect of blocking the toner. If the distance d2 is longer than the maximum magnetic brush length by 1.0 mm or more, the effect of blocking the toner becomes weakened. On the other hand, if the distance d2 is shorter than the maximum magnetic brush length by 1.0 mm or more, the developer may be lodged at the facing part.

The maximum magnetic brush length here refers to the maximum value of a vertical distance from the surface of the magnet roller 63 to the leading end of the magnetic brush at the part of the magnet roller 63 facing the toner blocking member 65. Since the development roller 64 is coated only with toner, the distance d2 between the toner blocking member 65 and the magnet roller 63 can be further shortened, or rather is desirably shortened in order to enhance the effect of blocking the toner.

The flow of the toner cannot be fully blocked only by providing the toner blocking member 65 in the space S between the magnet roller 63 and the development roller 64 and the wall part 71, so that the toner will leak out of the gap and scatter to the outside of the development device 60. In addition, the toner may adhere to the toner blocking member 65 and fall therefrom in drops to affect the quality of the images. In particular, if the toner blocking member 65 is arranged above the magnet roller 63 as seen in the vertical direction, the toner may fall in drops onto the magnet roller 63, which may cause the toner density to become high in spots where the droplets of the toner have fallen. As a result, the image density is likely to increase after a rotation of the magnet roller 63.

Thus, in the first exemplary embodiment, when the magnet roller 63 and the development roller 64 are driven, a direct-current potential Vdc3, which has the same polarity as the normally charged toner and is larger in absolute value than the potentials of the development roller 64 and the magnet roller 63, is applied to the toner blocking member 65.

That is, during an image formation operation, a potential difference (first potential difference) is formed between the magnet roller 63 and the development roller 64 such that the normally charged toner travels from the magnet roller 63 to the development roller 64. In addition, during an image formation operation, a potential difference (second potential difference) is formed between the toner blocking member 65 and the development roller 64 such that the normally charged toner travels from the toner blocking member 65 to the development roller 64. Furthermore, during an image formation operation, a potential difference (third potential difference) is formed between the toner blocking member 65 and the magnet roller 63 such that the normally charged toner travels from the toner blocking member 65 to the magnet roller 63. The second potential difference is larger than the first potential difference and the third potential difference. In such a manner, the bias application unit applies biases to the magnet roller 63, the development roller 64, and the toner blocking member 65 to form the first potential difference, the second potential difference, and the third potential difference therebetween.

The configuration as described above allows the toner to be pressed from the toner blocking member 65 against the development roller 64 due to the potential difference between the toner blocking member 65 and the development roller 64.

The configuration as described above also allows the toner to be pressed from the toner blocking member 65 against the magnet roller 63 due to the potential difference between the toner blocking member 65 and the magnet roller 63.

As a result, the toner floating in the gap between the toner blocking member 65 and the development roller 64 is collected by the development roller 64, and the toner floating in the gap between the toner blocking member 65 and the magnet roller 63 is collected by the magnet roller 63. The present exemplary embodiment can prevent the toner floating in the space S between the magnet roller 63 and the development roller 64 and the wall part 71 from scattering to the outside of the housing 70, and can also prevent the toner from adhering to the surface of the toner blocking member 65 and falling therefrom in drops.

In the first exemplary embodiment, the application voltage Vdc3 applied to the toner blocking member 65 is set to 800 V (Vdc3=800 V).

The application voltage Vdc3 applied to the toner blocking member 65 is made larger than the direct-current component of the bias applied to the development roller 64 (Vdc1=70 V) and the direct-current component of the bias applied to the magnet roller 63 (Vdc2=350 V). This achieves the advantageous effects described above.

Further, in the first exemplary embodiment, the application voltage to the toner blocking member 65 (Vdc3=800 V) is set to be smaller than a maximum value of the positive (+) component of the bias applied to the development roller 64 (Vpp1(max)=910 V) having the alternating-current component and direct-current component superimposed on each other. That is, the absolute value of the potential of the direct-current component of the bias applied to the toner blocking member 65 is set to be smaller than the absolute value of the peak potential on the same polarity side as the normally charged toner out of the alternating-current component of the bias applied to the development roller 64.

In the first exemplary embodiment, the application voltage to the toner blocking member 65 (Vdc3=800 V) is set to be smaller than a maximum value of the positive (+) component of the bias applied to the magnet roller 63 (Vpp2(max)=1565 V) having the alternating-current component and the direct-current component superimposed on each other. That is, the absolute value of the potential of the direct-current component of the bias applied to the toner blocking member 65 is set to be smaller than the absolute value of the peak potential on the same polarity side as the normally charged toner out of the alternating-current component of the bias applied to the magnet roller 63.

The above-described settings are made for the two reasons described below. The one of the reasons is to suppress the occurrence of a leak due to an excessively large potential difference between the toner blocking member 65 and the development roller 64 caused by the alternating-current component of the bias applied to the development roller 64, and to suppress the occurrence of a leak due to an excessively large potential difference between the toner blocking member 65 and the magnet roller 63 caused by the alternating-current component of the bias applied to the magnet roller 63.

The second reason is as follows. The above-described settings invert the magnitude relationship between the application voltage to the toner blocking member 65 and the application voltages to the development roller 64 and the magnet roller 63 for a certain period of time, thereby facilitating separation of the toner from the toner blocking member 65. In the first exemplary embodiment, the application voltage Vdc3 to the toner blocking member 65 is more desirably set to be smaller than both the maximum values Vpp1(max) and Vpp2(max) of the positive (+) components of the biases to the development roller 64 and the magnet roller 63. On the other hand, in order to obtain the effect of facilitating separation of the toner from the toner blocking member 65, the application voltage Vdc3 to the toner blocking member 65 is set to be smaller than the maximum value Vpp1(max) of the positive (+) component of the bias applied to the development roller 64, or is set to be smaller than the maximum value Vpp2(max) of the positive (+) component of the bias applied to the magnet roller 63. Applying either one of these settings produces a corresponding effect. In the case of using a negatively charged toner, a similar effect can be obtained by setting the absolute value of the application voltage Vdc3 to the toner blocking member 65 to be smaller than both the maximum values Vpp1(max) and Vpp2(max) of the absolute values of the negative (−) components of the biases applied to the development roller 64 and the magnet roller 63. In the case of using a negatively charged toner, a similar advantageous effect can be obtained in terms of the absolute values.

Electric discharge (leak) will be described here. If the application voltage Vdc3 to the toner blocking member 65 is further increased, the potential difference from the direct-current component Vdc1 of the bias applied to the development roller 64 and the potential difference from the direct-current component Vdc2 of the bias applied to the magnet roller 63 can be further increased, thereby enhancing the effect of blocking the toner. However, an excessively large potential difference therebetween may cause a leak. In the event of a leak, the biases may be disturbed. The disturbance of the biases may result in defective images.

As described above, in the first exemplary embodiment, the normally charged toner is positively charged toner. Thus, in the first exemplary embodiment, the direct-current component Vdc2 of the bias applied to the magnet roller 63 is set to be larger than the direct-current component Vdc1 of the bias applied to the development roller 64. In addition, the application voltage Vdc3 to the toner blocking member 65 is set to be larger than the direct-current component Vdc2 of the bias applied to the magnet roller 63. That is, the following relationship is established: "the absolute value of the direct-current component Vdc1 of the bias applied to the development roller 64"<"the absolute value of the direct-current component Vdc2 of the bias applied to the magnet roller 63"<"the absolute value of the application voltage Vdc3 to the toner blocking member 65". However, the direct-current component Vdc1 of the bias applied to the development roller 64, the direct-current component Vdc2 of the bias applied to the magnet roller 63, and the application voltage Vdc3 to the toner blocking member 65 are the same in polarity as the normally charged toner.

As described above, in the first exemplary embodiment, the application voltage Vdc3 to the toner blocking member 65 is set to be large so that the potential difference between the development roller 64 and the toner blocking member 65 is likely to be large in particular.

Thus, in the first exemplary embodiment, an insulating layer is provided on the surface of the toner blocking member 65. Insulating the surface of the toner blocking member 65 can suppress the occurrence of a leak. The insulation layer has the effect of suppressing a leak as long as it is made of an insulating material. In the case of using normally charged toner, selecting a material for the insulating layer that is likely to be charged to the positive (+) polarity that is the same as the polarity of the toner makes the toner unlikely to adhere to the surface of the insulating layer because the same polarities are prone to repel each other. Thus, in the first exemplary embodiment, a polyimide tube that is easily charged to the positive (+) polarity is used, and the insulating layer is formed on the surface of the toner blocking member 65 by utilizing the thermal contraction of the polyimide tube. In the case of using negatively charged toner, a perfluoroalkoxy alkane (PFA) (fluororesin) tube that is easily charged to the negative (−) polarity or the like is desirably used.

A high-voltage power source unit (another power source) may be separately provided to apply the application voltage Vdc3 to the toner blocking member 65. However, a separate high-voltage power source unit (another power source) is not necessarily provided if the application voltage is generated from the bias applied to the development roller 64 or the bias applied to the magnet roller 63. For example, the use of a double-voltage rectifier circuit allows the output of a direct-current bias that is substantially equal to the peak-to-peak value of the alternating-current component of the input bias. In the first exemplary embodiment, the alternating-current component of the peak-to-peak voltage of 1.4 kV (Vpp1=1.4 kV) is applied to the development roller 64, and the alternating-current component of the peak-to-peak voltage of 1.75 kV (Vpp2=1.75 kV) is applied to the magnet roller 63.

Accordingly, the application voltage to the toner blocking member 65 (Vdc3=800V) can be generated by a double-voltage rectifier circuit using either of the peak-to-peak voltages Vpp1 and Vpp2. If the desired voltage cannot be obtained by a double-voltage rectifier circuit because the peak-to-peak value of the alternating-current component of the input bias is small or the influence of a voltage drop due to resistance or the like is large, a peak hold circuit or the like may be used.

One of the advantages of generating the application voltage Vdc3 to the toner blocking member 65 from the bias applied to the development roller 64 or the magnet roller 63 is that there is no need to provide another high-voltage power source unit separately. Another advantage is as follows. If a high-voltage power source unit is provided independently of the development roller 64 and the magnet roller 63, there are some cases that the application voltage Vdc3 is not applied to the toner blocking member 65 (=0 V) due to a failure or the like of the high-voltage power source unit. In this case, the relationships in potential with the development roller 64 and the magnet roller 63 may be reversed so that the toner may move to the toner blocking member 65. In addition, if a high-voltage power source unit is provided independently of the development roller 64 and the magnet roller 63 and the application voltage Vdc3 is not applied to the toner blocking member 65 (=0 V) due to a failure or the like of the high-voltage power source unit, the potential differences from the development roller 64 and the magnet roller 63 may become unnecessarily large. In the first exemplary embodiment, the maximum value of the application voltage to the magnet roller 63 is larger than the maximum value of the application voltage to the development roller 64, and the potential difference between the magnet roller 63 and the toner blocking member 65 is 1565 V, which may result in a leak.

Thus, in the first exemplary embodiment, the bias to be applied to the toner blocking member 65 is generated by a double-voltage rectifier circuit from the bias applied to the magnet roller 63. From the advantages described above, it is desirable to use not different power sources but the same power source to generate the bias to be applied to the magnet roller 63 and generate the bias to be applied to the toner blocking member 65. However, it is obvious that the disclosure according to the first exemplary embodiment can be similarly applied to a modification example in which the power source for generating the bias to be applied to the magnet roller 63 and the power source for generating the bias to be applied to the toner blocking member 65 are different.

In the first exemplary embodiment, as described above, the toner blocking member 65 is arranged in the space S between the magnet roller 63 and the development roller 64 and the wall part 71, which is located downstream of the closest position P1 where the development roller 64 and the magnet roller 63 are closest to each other as seen in the rotation direction of the magnet roller 63.

The toner blocking member 65 is arranged downstream of the position where the development roller 64 develops the electrostatic latent image formed on the photoconductive drum 50 as seen in the rotation direction of the development roller 64 and upstream of the closest position P1 where the development roller 64 and the magnet roller 63 are closest to each other as seen in the rotation direction of the development roller 64.

The toner is pressed from the toner blocking member 65 against the development roller 64 due to the potential difference between the toner blocking member 65 and the development roller 64. In addition, the toner is pressed from the toner blocking member 65 against the magnet roller 63 due to the potential difference between the toner blocking member 65 and the magnet roller 63. As a result, the toner floating in the gap between the toner blocking member 65 and the development roller 64 is collected by the development roller 64, and the toner floating in the gap between the toner blocking member 65 and the magnet roller 63 is collected by the magnet roller 63. The present exemplary embodiment can prevent the toner floating in the space S between the magnet roller 63 and the development roller 64 and the wall part 71 within the housing 70 from being carried by a flow of air and scattered to the outside of the housing 70.

In the first exemplary embodiment, only the direct-current component of the bias is applied to the toner blocking member 65 as an example. In contrast, the second exemplary embodiment is different from the first exemplary embodiment in that a bias of which a direct-current component and an alternating-current component are superimposed on each other is applied to the toner blocking member 65. In the second exemplary embodiment, only the difference from the first exemplary embodiment will be described. Other components and operations are similar to those of the first exemplary embodiment and therefore detailed description thereof will be omitted.

Applying the direct-current bias to the toner blocking member 65 enhances the effect of blocking the toner by an electrical field between the toner blocking member 65 and the magnet roller 63 and the effect of blocking the toner by an electrical field between the toner blocking member 65 and the development roller 64. However, since the magnitude relationship in potential between the biases varies with time, floating toner may be newly produced. In addition, an excessively large potential difference therebetween increases the concern about an occurrence of a leak.

Thus, in the second exemplary embodiment, a bias of which an alternating-current component is the same as the alternating-current component of the development roller 64 with a frequency of 4 kHz (f1=4 kHz), a peak-to-peak voltage of 1.4 kV (Vpp1=1.4 kV), and a duty ratio of 40% (Dslv=40%) and a direct-current component of 800 V (Vdc3=800 V) is different, is applied to the toner blocking member 65.

Application of the bias to the toner blocking member 65 causes the normally charged toner to receive a force acting in the direction of the development roller 64 without any change at least in the magnitude relationship in potential between the development roller 64 and the toner blocking member 65. In addition, the potential difference between the development roller 64 and the toner blocking member 65 does not become excessively large, thereby suppressing the occurrence of a leak.

In the second exemplary embodiment, the alternating-current component of the bias applied to the toner blocking member 65 is the same as the alternating-current component of the bias applied to the development roller 64. Alternatively, the alternating-current component of the bias applied to the toner blocking member 65 may be the same as the alternating-current component of the bias applied to the magnet roller 63. In this case, the normally charged toner is constantly subjected to a force in the direction of the magnet roller 63 without any change at least in the magnitude relationship in potential between the magnet roller 63 and the toner blocking member 65. In addition, the potential difference between the magnet roller 63 and the toner blocking member 65 does not become excessively large, thereby suppressing the occurrence of a leak.

However, among the direct-current component of the bias applied to the toner blocking member 65, the direct-current component of the bias applied to the development roller 64, and the direct-current component of the bias applied to the magnet roller 63, the absolute value of the direct-current component of the bias applied to the toner blocking member 65 is set to be the largest.

Accordingly, of the minimum value Vpp1(min) of the bias applied to the development roller 64 and the minimum value Vpp2(min) of the bias applied to the magnet roller 63, there is a higher degree of fear that a leak may occur in the gap between the toner blocking member 65 and the development roller 64 having the smaller value. Thus, it is more desirable that the alternating-current component of the bias applied to the toner blocking member 65 is the same as the alternating-current component of the bias applied to the development roller 64.

OTHER EXEMPLARY EMBODIMENTS

The present disclosure is not limited to the above-described exemplary embodiments, and various modifications (including organic combinations of the exemplary embodiments) are possible based on the gist of the present disclosure and are not excluded from the scope of the present disclosure.

The above exemplary embodiments have been described taking an image formation apparatus using the intermediate transfer belt 33 as an example, as illustrated in FIG. 1. However, the configuration of the image formation apparatus is not limited thereto. The present disclosure is also applicable to an image formation apparatus configured to transfer images onto the sheets P that are sequentially brought into direct contact with the photoconductive drums 50.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-020827, filed Feb. 12, 2021, which is hereby incorporated by reference herein in its entirety.

What is claimed is:

1. An image formation apparatus comprising:

an image-bearing member;

an exposure device configured to expose the image-bearing member to form an electrostatic latent image on the image-bearing member;

a development device including first and second chambers, first and second conveyance screws, a rotatable development roller, and a rotatable toner supply roller, wherein the first chamber is configured to accommodate a developer containing toner and a carrier, wherein the second chamber is divided from the first chamber by a partition wall and configured to form a circulation path of the developer between the second chamber and the first chamber, wherein the first conveyance screw is arranged in the first chamber and configured to convey the developer in a first direction, wherein the second conveyance screw is arranged in the second chamber and configured to convey the developer in a second direction opposite to the first direction, wherein the development roller is arranged facing the image-bearing member and configured to carry and convey the toner to a development position where the electrostatic latent image formed on the image-bearing member is developed, and wherein the toner supply roller is arranged facing the development roller and configured to carry and convey the developer supplied from the first chamber and supply only the toner to the development roller, where a rotation direction of the toner supply roller is opposite to a rotation direction of the development roller at a position where the toner supply roller and the development roller face each other;

an electro-conductive member arranged facing the toner supply roller and the development roller, downstream of the development position and upstream of a position where the toner supply roller is positioned closest to the development roller in the rotation direction of the development roller; and a bias application unit configured to apply biases to the toner supply roller, the development roller, and the electro-conductive member during an image formation operation so that (i) a first potential difference is formed between the toner supply roller and the development roller to cause normally charged toner to travel from the toner supply roller to the development roller, (ii) a second potential difference is formed between the electro-conductive member and the development roller to cause normally charged toner to travel from the electro-conductive member to the development roller, and (iii) a third potential difference is formed between the electro-conductive member and the toner supply roller to cause normally charged toner to travel from the electro-conductive member to the toner supply roller, wherein the second potential difference is larger than the first potential difference and is larger than the third potential difference.

2. The image formation apparatus according to claim 1, wherein a bias having a direct-current component and an alternating-current component superimposed on each other is applied to the toner supply roller, wherein the bias having the direct-current component and the alternating-current component superimposed on each other is applied to the development roller, and wherein the bias having the direct-current component and the alternating-current component superimposed on each other is applied to the electro-conductive member.

3. The image formation apparatus according to claim 2, wherein a polarity of the direct-current component of the bias applied to the toner supply roller, a polarity of the direct-current component of the bias applied to the development roller, and a polarity of the direct-current component of the bias applied to the electro-conductive member are the same as a polarity of normally charged toner, and wherein an absolute value of the direct-current component of the bias applied to the electro-conductive member is larger than an absolute value of the direct-current component of the bias applied to the toner supply roller, and is larger than an absolute value of the direct-current component of the bias applied to the development roller.

4. The image formation apparatus according to claim 2, wherein the alternating-current component of the bias applied to the electro-conductive member is the same as the alternating-current component of the bias applied to the toner supply roller.

5. The image formation apparatus according to claim 2, wherein the alternating-current component of the bias applied to the electro-conductive member is the same as the alternating-current component of the bias applied to the development roller.

6. The image formation apparatus according to claim 1, wherein a bias having a direct-current component and an alternating-current component superimposed on each other is applied to the toner supply roller, wherein the bias having the direct-current component and the alternating-current component superimposed on each other is applied to the development roller, and wherein a bias having a direct-current component alone is applied to the electro-conductive member.

7. The image formation apparatus according to claim 6, wherein a polarity of the direct-current component of the bias applied to the toner supply roller, a polarity of the direct-current component of the bias applied to the development roller, and a polarity of the direct-current component of the bias applied to the electro-conductive member are the same as a polarity of normally charged toner, and wherein an absolute value of the direct-current component of the bias applied to the electro-conductive member is larger than an absolute value of the direct-current component of the bias applied to the toner supply roller, and is larger than an absolute value of the direct-current component of the bias applied to the development roller.

8. The image formation apparatus according to claim 6, wherein an absolute value of a potential of the direct-current component of the bias applied to the electro-conductive member is smaller than an absolute value of a peak potential on the same polarity side as a polarity of normally charged toner out of the alternating-current component of the bias applied to the toner supply roller.

9. The image formation apparatus according to claim 6, wherein an absolute value of a potential of the direct-current component of the bias applied to the electro-conductive member is smaller than an absolute value of a peak potential on the same polarity side as a polarity of normally charged toner out of the alternating-current component of the bias applied to the development roller.

10. The image formation apparatus according to claim 1, wherein a power source configured to supply electric power for applying the bias to the toner supply roller by the bias application unit during the image formation operation and a power source configured to supply electric power for applying the bias to the electro-conductive member by the bias application unit during the image formation operation are used in common with each other.

11. The image formation apparatus according to claim 1, wherein a power source configured to supply electric power for applying the bias to the development roller by the bias application unit during the image formation operation and a power source configured to supply electric power for applying the bias to the electro-conductive member by the bias application unit during the image formation operation are used in common with each other.

12. The image formation apparatus according to claim 1, wherein the toner supply roller includes a first magnet having a plurality of magnetic poles including a first magnetic pole, where the first magnet is fixedly arranged not to rotate inside the toner supply roller, and wherein the development roller includes a second magnet having one magnet pole as a second magnetic pole arranged facing the first magnetic pole and different in polarity from the first magnetic pole, where the second magnet is fixedly arranged not to rotate inside the development roller.

13. The image formation apparatus according to claim 1, wherein the electro-conductive member is an electro-conductive roller, and wherein a shortest distance between the development roller and the electro-conductive roller is shorter than a shortest distance between the toner supply roller and the electro-conductive roller.

14. The image formation apparatus according to claim 1, wherein the electro-conductive member is an electro-conductive roller, wherein a shortest distance between the development roller and the electro-conductive roller is 0.3 mm or less, and wherein a shortest distance between the toner supply roller and the electro-conductive roller is 2 mm or less.

15. The image formation apparatus according to claim 14, wherein a diameter of the electro-conductive roller is 4 mm or more.

16. The image formation apparatus according to claim 1, wherein a surface of the electro-conductive member is insulated.

* * * * *